US007999641B2

(12) United States Patent
Broghammer et al.

(10) Patent No.: US 7,999,641 B2
(45) Date of Patent: Aug. 16, 2011

(54) CIRCUIT BREAKER HAVING REDUCED AUXILIARY TRIP REQUIREMENTS

(76) Inventors: William J. Broghammer, Cedar Rapids, IA (US); Cameron L. Woodson, Cedar Rapids, IA (US)

( * ) Notice: Subject to any disclaimer, the term of this patent is extended or adjusted under 35 U.S.C. 154(b) by 448 days.

(21) Appl. No.: 12/338,172

(22) Filed: Dec. 18, 2008

(65) Prior Publication Data

US 2010/0156576 A1 Jun. 24, 2010

(51) Int. Cl.

| | |
|---|---|
| ***H01H 81/00*** | (2006.01) |
| ***H01H 83/00*** | (2006.01) |
| ***H01H 75/12*** | (2006.01) |
| ***H01H 77/00*** | (2006.01) |
| ***H01H 75/00*** | (2006.01) |

(52) U.S. Cl. ..... 335/35; 335/6; 335/8; 335/9; 335/10; 335/21; 335/22; 335/23; 335/36; 335/145; 335/172

(58) Field of Classification Search ..... 335/6, 8–10, 335/16, 21–23, 35, 36, 38, 68, 77, 145, 170, 335/172–174, 208

See application file for complete search history.

(56) References Cited

U.S. PATENT DOCUMENTS

| | | | | |
|---|---|---|---|---|
| 2,607,868 | A * | 8/1952 | Platz | 335/164 |
| 4,276,526 | A * | 6/1981 | Ciarcia et al. | 335/35 |
| 4,604,596 | A * | 8/1986 | Yokoyama et al. | 335/14 |
| 4,616,199 | A | 10/1986 | Oster | |
| RE32,882 | E * | 3/1989 | Yokoyama et al. | 335/14 |
| 4,855,701 | A * | 8/1989 | Yokoyama et al. | 335/230 |
| 5,245,302 | A | 9/1993 | Brune et al. | |
| 5,381,120 | A * | 1/1995 | Arnold et al. | 335/35 |
| 5,682,101 | A | 10/1997 | Brooks et al. | |
| 5,864,266 | A | 1/1999 | Mickelson et al. | |
| 6,591,482 | B1 | 7/2003 | Fleege et al. | |
| 2004/0196123 | A1 * | 10/2004 | Simms et al. | 335/6 |

* cited by examiner

*Primary Examiner* — Anh T Mai
*Assistant Examiner* — Mohamad A Musleh

(57) ABSTRACT

A bimetal in a circuit breaker can deflect in a first direction or a second direction depending upon conditions. If the bimetal deflects in the second direction it can increase the force necessary to operate a trip mechanism of the circuit breaker. A yoke stop helps to control bimetal deflection forces and thus, the amount of force necessary to operate the trip mechanism. This allows better control, size, and selection of operating parts for the circuit breaker.

18 Claims, 3 Drawing Sheets

CIRCUIT BREAKER HAVING REDUCED AUXILIARY TRIP REQUIREMENTS

FIELD OF THE INVENTION

This invention is directed generally to a circuit breaker, and, more particularly, to a circuit breaker having reduced auxiliary trip requirements.

BACKGROUND OF THE INVENTION

Circuit breakers provide automatic current interruption to a monitored circuit when undesired fault conditions occur. These fault conditions include, for example, arc faults, overloads, ground faults, and short-circuits. Referring to FIG. 1, a portion of an exemplary prior art circuit breaker 1 is shown. In the circuit breaker 1, an overcurrent is detected when the fault current generates sufficient heat in a terminal 20 and a bimetal 10 to cause the bimetal 10 to deflect and/or bend. The mechanical deflection triggers a trip assembly that includes a spring-biased trip lever 50 to force a moveable contact attached to a moveable conductive blade away from a stationary contact, thereby breaking the circuit. When the circuit is exposed to a current above that level for a predetermined period of time, the trip assembly activates and tripping occurs thereby opening the circuit.

The bimetal 10 deflects in a predictable and repeatable manner across a thermal profile over a period of time. The bimetal 10 is attached to a yoke 30 that is magnetically coupled to a moveable armature 40. The movement of the bimetal 10 in response to excessive electrical current causes the yoke 30 to move the armature 40, which triggers a chain of mechanical actions that cause the circuit breaker 1 to thermally trip. For magnetic tripping in response to sudden overloads (e.g., a short circuit condition), a magnetic field induced relative to the magnetic yoke 30 causes the armature 40 to be moved relative to the yoke 30, which triggers a chain of mechanical actions that cause the circuit breaker 1 to magnetically trip. However, the circuit breaker 1 is unable to magnetically trip in certain situations, such as extreme cold environments without a thermal-assist. Such a situation is illustrated in FIG. 1 as the armature 40 is pulled to an inner surface of the yoke 30 yet the trip lever 50 remains engaged with the armature 40.

The circuit breaker 1 also includes a solenoid 70 coupled to electronic components that detect one or more fault conditions and are operable to cause the circuit breaker 1 to electronically trip. The solenoid 70 and the electronic components can be in addition to or in lieu of the thermal-magnetic tripping components. The electronic components process a signal output of a sensor that monitors current flowing in the circuit breaker 1. The electronic components are configured to determine whether one of the fault conditions is present and to generate a fault signal and/or a trip signal. In response to the generation of a fault signal, a magnetic field is created around the solenoid 70, causing a plunger to move the armature 40 relative to the yoke 30, which triggers a chain of mechanical actions that cause the circuit breaker 1 to electronically trip.

Extreme cold temperature conditions, for example, negative thirty-five degrees Celsius, may cause the bimetal 10 to deflect in the direction of arrow B with a "bimetal deflection force," which requires the circuit breaker to use either thermal-assist or a solenoid to overcome the bimetal deflection force to trip. For a magnetic trip, a magnetic deflection force can cause the bimetal 10 to take a mechanical set that increases the tripping time beyond allowable limits. Similarly, for an electronic trip, the additional bimetal deflection force, which can be multiple times as great as normal latch engagement forces, requires an auxiliary trip device, such as the solenoid 70, to reliably overcome the latch engagement forces between the trip lever 50 and the armature 40 and the bimetal deflection force. Thus, the circuit breaker 1 employing an auxiliary trip device must include a larger solenoid 70 to trip the circuit breaker in cold environments within the allowable tripping time. These larger solenoids are physically larger that generate a larger pull force, however, the larger solenoids also require larger overall circuit breaker housings. Thus, in practice, as space in a circuit breaker is at a premium, miniature circuit breakers tend to not supply large solenoids and therefore may not operate effectively in extreme ambient temperatures, such as, for example, negative thirty-five degrees Celsius.

In miniature circuit breakers, such as the QO® and HOMELINE® family of circuit breakers available from Square D Company, the outer dimensions of the circuit breaker housing limit the size of the solenoid that can be used. In these circuit breakers having such solenoids, cold performance may not be achievable.

Thus, a need exists for an improved apparatus and method. The present invention is directed to satisfying one or more of these needs and solving other problems.

SUMMARY OF THE INVENTION

Circuit breakers use free moving bimetallic strips attached to armature/yoke assemblies as a principal means to thermally sense overcurrents and open the circuit breaker contacts (i.e., trip the breaker). The disclosure teaches a yoke stop configured and positioned to reduce tripping requirements of a bimetal equipped circuit breaker and the tripping force required of auxiliary tripping devices such as solenoids.

The solenoid in a circuit breaker operating in cold temperatures typically has three opposing forces to overcome when tripping the circuit breaker. Namely, an armature biasing force, a frictional engagement force, and a bimetal deflection force. The present disclosure provides circuit breaker configurations and methods for eliminating the effects of the bimetal deflection force in cold temperatures when magnetically tripping the circuit breaker and when using a solenoid to trip the circuit breaker. Put another way, the circuit breaker of the present disclosure includes a yoke stop for absorbing the bimetal deflection force such that the tripping force required to trip the circuit breaker is independent of the bimetal deflection force, thereby reducing the tripping requirements of the circuit breaker.

Such a reduction of tripping requirements reduces the required solenoid size, which can reduce the overall size of the circuit breaker. Additionally, reducing of the tripping requirements yields a more robust tripping system that is more reliable. Moreover, such reduced tripping requirements provide circuit breakers operable in extreme ambient temperatures, such as, for example, negative thirty-five degrees Celsius or lower.

Additional benefits of the invention may include the elimination of thermal-assist tripping. Thermal-assist tripping requires more time to clear the circuit than straight magnetic tripping, which may be undesirable. Additionally, the disclosure can be implemented in multi-pole circuit breakers, such as, for example, a three-pole circuit breaker. The disclosure provides methods and apparatuses for reducing the overall tripping requirements such that tripping of one pole is sufficient to trip the other poles without having to rely on thermal-assist tripping or other undesirable methods.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

The invention may best be understood by reference to the following description taken in conjunction with the accompanying drawings, in which.

DETAILED DESCRIPTION OF THE ILLUSTRATED EMBODIMENTS

Although the invention will be described in connection with certain preferred embodiments, it will be understood that the invention is not limited to those particular embodiments. On the contrary, the invention is intended to include all alternatives, modifications and equivalent arrangements as may be included within the spirit and scope of the invention as defined by the appended claims.

Figure 2:
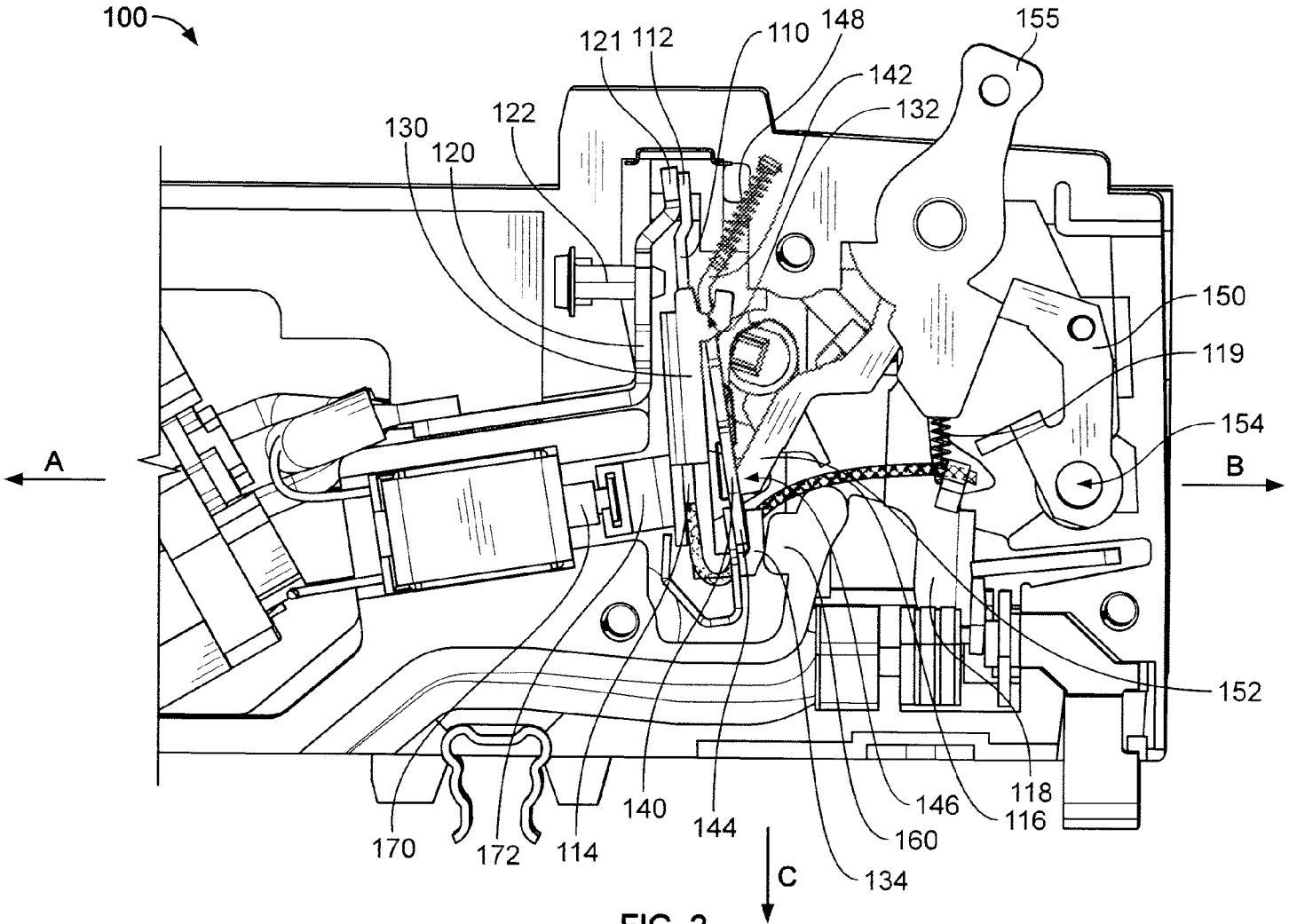
FIG. 2 is a top plan view of a circuit breaker according to aspects of the present disclosure.

Referring now to the drawings and initially to FIG. 2, there is shown a circuit breaker 100 that includes a bimetal 110 attached to a load terminal 120 at a load end 112 of the bimetal 110 and to a yoke 130 at a free end 114 of the bimetal 110. The free end 114 of the bimetal is attached to a flexible pigtail conductor 116 such that the bimetal 110 is directly heated by the attached pigtail conductor 116. According to some embodiments, the circuit breaker is a miniature circuit breaker with an overall width of a housing of the circuit breaker being about 1 inch or smaller, preferably about ⅜ inch. According to some embodiments, the circuit breaker is a three-pole circuit breaker wherein three poles are assembled in a common housing. The three poles are interconnected with a common trip bar such that tripping one pole causes the other poles to trip. For ease of illustration, the following description focuses on a single-pole circuit breaker, although the invention can be applied to any number of poles in a circuit breaker. Additionally, some components of the circuit breaker 100 are omitted or not described, however, these components, which may be found in, for example, the QO® or Homeline® miniature circuit breakers available from Square D Company, are not necessary for an understanding of aspects of the present invention.

Current flows into the circuit breaker 100 and into a stationary contact. A moveable contact is removably coupled to the stationary contact. The moveable contact is fixed to a moveable conductive blade 118. The moveable conductive blade 118 is moveable between an "on" position, where the moveable contact abuts or electrically connects with the stationary contact, and an "off" position, where the moveable contact is disconnected or removed from contact with the stationary contact. The moveable conductive blade 118 is coupled to a trip lever 150 via a spring 119. The moveable conductive blade 118 is pivotally coupled to a handle 155. The handle 155 has an "on" position and an "off" position. The on position of the handle 155 can also be referred to as a "latched" or "engaged" position. The on and off positions of the handle 155 correspond to the on and off positions of the moveable conductive blade 118. Thus, switching the handle from the off position to the on position causes the moveable contact blade 118 to swing from the off position to the on position, thereby completing the electrical circuit in the circuit breaker. As will be discussed below in greater detail, tripping the circuit breaker 100 from the on position to a "tripped" position causes the trip lever 150 to rotate about a pivot point 154 in the direction of arrow C, thereby causing the spring 119 to cause the moveable contact blade 118 to swing away from and out-of-contact with the stationary contact, thereby breaking the flow of current across the circuit breaker 100.

The moveable conductive blade 118 is coupled to the flexible pigtail conductor 116, which couples the moveable conductive blade 118 to the free end 114 of the bimetal 110. Current flows through the bimetal 110 from the free end 114 to the load end 112 and from the load end 112 to the load terminal 120.

The bimetal 110 has a calibrated position, which is adjustable via a calibration screw 122. An operator of the circuit breaker 100 can turn the calibration screw 122 to cause the bimetal 110 to deflect or bend in the direction of arrow A. Turning the calibration screw 122 bends the load terminal 120 such that a free end 121 of the load terminal 120 deflects in the direction of arrow B. As the free end 121 of the load terminal 120 is coupled to the load end 112 of the bimetal 110, the deflection of the load terminal 120 in the direction of arrow B causes the free end 114 of the bimetal 110 to move in the direction of arrow A. Adjusting the free end 114 of the bimetal 110 ultimately moves the yoke 130, which is coupled to the free end 114 of the bimetal 110. Thus, as the bimetal 110 moves in the direction of arrow A the yoke 130 also moves in the direction of arrow A.

The yoke 130 includes a pivot end 132 and a hook end, which includes a yoke hook 134. The yoke hook 134 can be positioned within the circuit breaker 100 using the calibration screw 122. Attached to the pivot end 132 of the yoke 130 is an armature 140. The armature 140 has a pivot end 142 and a free end 144. The armature 140 includes a latch seat 146 or a void for receiving a latching end 152 of the trip lever 150. The pivot end 142 of the armature 140 is coupled to the housing of the circuit breaker 100 via a spring 148. The spring 148 resiliently holds the armature 140 in a pivoting position such that the pivot end 142 of the armature 140 pivots on the pivot end 132 of the yoke 130.

In FIG. 2, the trip lever 150 is shown in an engaged or an un-tripped position as the latching end 152 of the trip lever 150 is engaged with the latch seat 146 of the armature 140. The latching end 152 engages the latch seat 146 with a sufficient amount of contact surface area to maintain the physical engagement during normal operational conditions of the circuit breaker that is under non-fault conditions. In the engaged position, the latching end 152 exerts a downward force in the direction of arrow C due to the spring 119 pulling or forcing the trip lever 150 in the direction of arrow C. The downward force also increases a sliding frictional engagement force between the latching end 152 and the latch seat 146 as the armature 140 is pulled in the direction of arrow A from an engaged position (shown in FIG. 2) to a tripped position (shown in FIG. 3B). Additionally, as the armature 140 is pulled in the direction of arrow A, its spring 148 exerts an armature biasing force in the direction of arrow B. Thus, to trip the circuit breaker 100, the armature 140 is moved from the engaged position to the tripped position thereby overcoming at least the frictional engagement force and the armature biasing force. These forces must be overcome to trip the circuit breaker 100, which can be called the normal tripping forces. The engaged and tripped positions of the armature 140 are discussed in greater detail below in reference to FIGS. 3A-3B.

The circuit breaker 100 includes an auxiliary trip mechanism 170. The auxiliary trip mechanism 170 is shown as a solenoid, but other mechanisms are contemplated. For simplicity the auxiliary trip mechanism 170 will be described as a solenoid. The solenoid 170 is coupled to the armature 140 via a trip link 172. The solenoid 170 is electrically coupled to a sensor that monitors, for example, electrical current running through the circuit breaker 100. The sensor is coupled to electronics that analyze a signal output from the sensor to determine if a particular fault condition has occurred. These fault conditions can include, but are not limited to, ground faults, arcing faults, overloads, and short-circuits. Upon the occurrence of a fault condition, the solenoid 170 can be configured to trip the circuit breaker by energizing a coil that causes a plunger to pull the trip link 172, which in turn pulls the armature 140 in the direction of arrow A, thereby disengaging the trip lever 150 from the latch seat 146.

The circuit breaker 100 includes a yoke stop 160. The yoke stop 160 can be integral with the housing of the circuit breaker 100 or alternatively, the yoke stop 160 can be a separate piece attached to the housing. The yoke stop 160 is positioned adjacent to the yoke hook 134 such that the operator can calibrate the position of the yoke hook 134 relative to the yoke stop 160 by turning the calibration screw 122. According to some embodiments, the calibration screw 122 is turned such that the yoke hook 134 abuts or contacts the yoke stop 160 when the handle 155 is in the on position. Alternatively, the circuit breaker 100 can be calibrated such that yoke hook 134 is positioned adjacent to the yoke stop 160 when the handle is in the on position. According to one embodiment, the yoke stop 160 can reduce some of the contact surface area between the trip lever 150 and the latch seat 146. However, the yoke stop 160 still allows for a sufficient amount of contact surface area for latch engagement. Additionally, the yoke stop 160 eliminates the effects of a bimetal deflection force for magnetic tripping and electronically detected fault tripping.

Figure 3A:
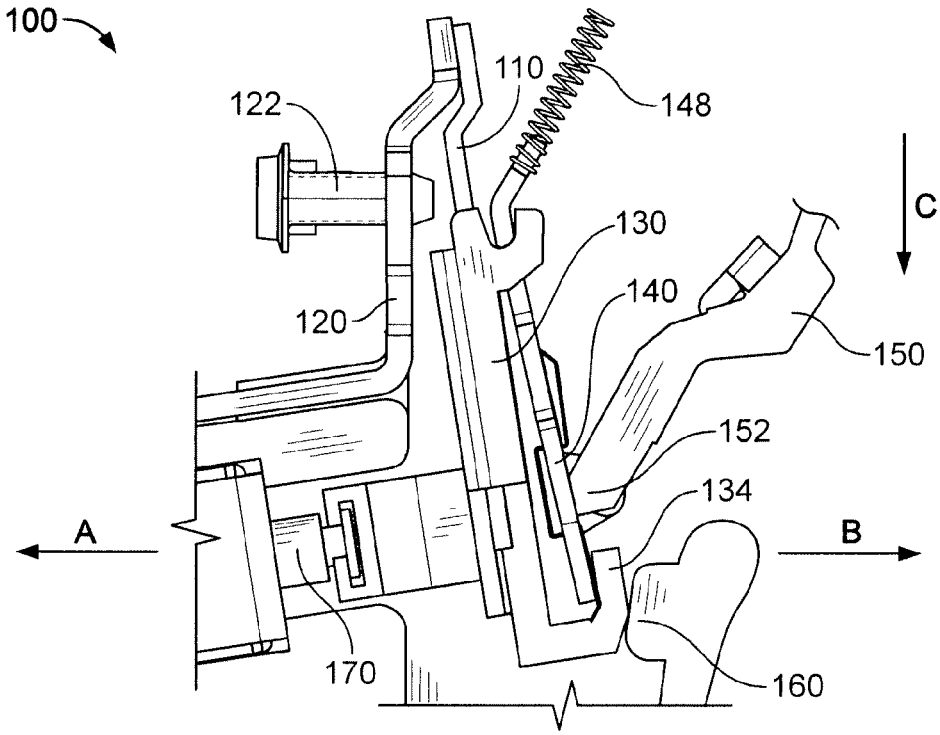
FIG. 3A is a partial top view of the circuit breaker of FIG. 2 in an on position.
Figure 3B:
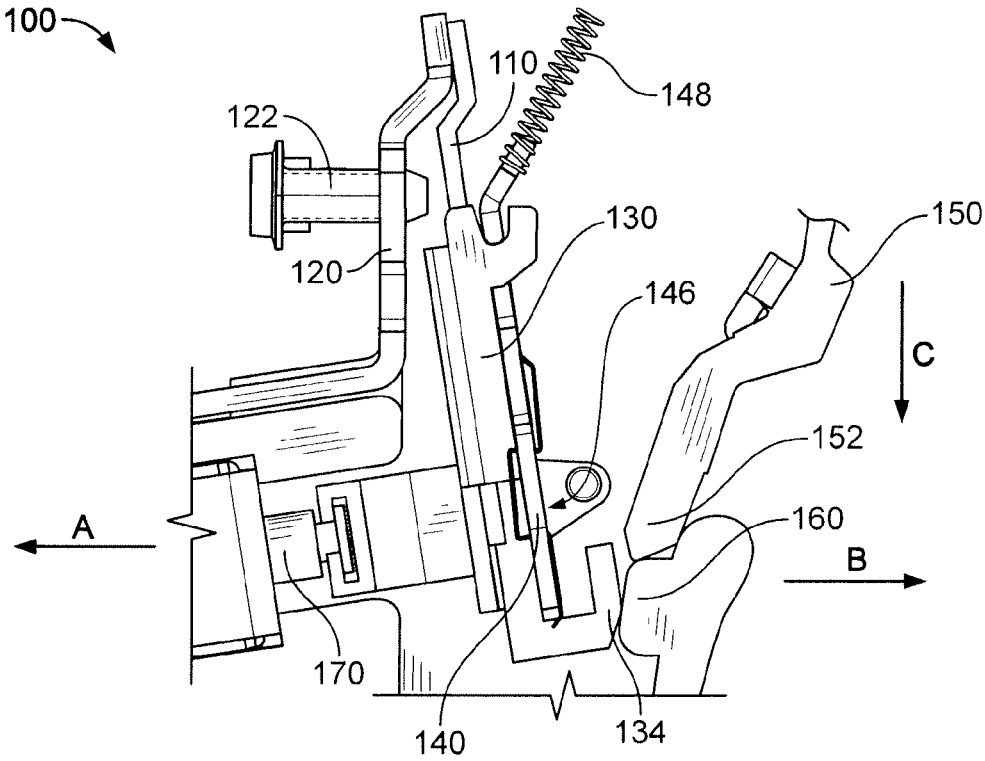
FIG. 3B is a partial top view of the circuit breaker of FIG. 2 in a tripped position.

Referring also to FIGS. 3A and 3B, the circuit breaker 100 is shown in the engaged position and the tripped position, respectively. FIG. 3A shows the trip lever 150 being engaged with the latch seat 146 of the armature 140. The armature 140 is in the engaged position such that the free end 144 of the armature 140 contacts an inner surface of the yoke hook 134. Alternatively, the armature can be calibrated such that the free end 144 of the armature 140 is spaced a predetermined distance from the inner surface of the yoke hook 134.

As discussed above, the bimetal 110 is configured to deflect in the direction of arrow A when the calibration screw 122 is turned. Additionally, an ambient temperature and the temperature of the bimetal 110 affect the direction and an amount of deflection of the bimetal 110. For example, when current runs through the bimetal 110, the current heats up the bimetal causing the bimetal 110 to deflect in the direction of arrow A. Upon the occurrence of a sustained current overload, the bimetal 110 is configured to deflect in the direction of arrow A such that the bimetal 110 causes the yoke 130 to move in the direction of arrow A, which in turn causes the yoke hook 134 to pull the armature 140 in the direction of arrow A. After an amount of deflection in the direction of arrow A, the yoke hook 134 eventually disengages the trip lever 150 from the latch seat 146, thereby tripping the circuit breaker 100 and turning the circuit breaker 100 from the on position to the tripped position. Such a tripping of the circuit breaker 100 via the bimetal 110 deflection is known as a thermal trip.

For another example of how temperature affects the direction and amount of deflection of the bimetal 110, extreme cold ambient temperatures can cause the bimetal 110 to deflect in the direction of arrow B. Specifically, in an ambient temperature of less than negative thirty-five degrees Celsius the bimetal 110 deflects in the direction of arrow B. As the free end 114 of the bimetal 110 is coupled to the yoke 130, the deflecting bimetal 110 causes the yoke hook 134 to move in the direction of arrow B; however, as shown in FIG. 3A, the yoke stop 160 is positioned such that the yoke hook 134 cannot be moved in the direction of arrow B. Thus, the deflection of the bimetal 110 in the direction of arrow B causes the bimetal 110 to load like a leaf spring. Put another way, as the ambient temperature decreases, the bimetal deflection force in the direction of arrow B increases. As the ambient temperature increases or as an overcurrent heats the bimetal 110, the bimetal deflection force in the direction of arrow B decreases until the bimetal 110 deflects the direction of arrow A. The bimetal deflection force can be multiple times greater than the armature biasing force, the frictional engagement force discussed above in relation to FIG. 2, or a sum of both forces. According to some embodiments, the bimetal deflection force is one to four times greater than a sum of the armature biasing force plus the frictional engagement force. According to some embodiments, the bimetal deflection force is two times greater than a sum of the armature biasing force plus the frictional engagement force.

The calibrated and relative positioning of the bimetal 110 and the yoke stop 160 cause the bimetal deflection force to be absorbed by the yoke stop 160 such that the solenoid 170 can pull the armature in the direction of arrow A, thereby tripping the circuit breaker 100, independently of the bimetal deflection force. Put another way, the extreme ambient temperature will not significantly affect the tripping requirements of the solenoid 170. According to some embodiments, the solenoid 170 can trip the circuit breaker 100 in an ambient temperature between sixty-six degrees Celsius and negative thirty-five degrees Celsius within eight-half cycles of current.

Besides cold-induced bimetal deflection force, the tripping force requirements to trip the circuit breaker 100 can be larger than the normal tripping forces due to, for example, the initial calibration setting of the calibration screw 122 and/or the initial placement of the free end 144 of the armature 140 relative to the yoke hook 134. According to some embodiments, the tripping force can be limited to being less than a sum of the frictional engagement force, the armature biasing force, and the bimetal deflection force. According to some embodiments, the tripping force can be limited to being less than the bimetal deflection force. According to some embodiments, the tripping force is no more than ten percent more than the sum of the frictional engagement force and the armature biasing force. According to some embodiments, the tripping force is less than the bimetal deflection force when the ambient temperature is no more than negative thirty-five degrees Celsius. According to some embodiments, the tripping force is less than the bimetal deflection force when the ambient temperature is negative thirty-five degrees Celsius or colder. According to some embodiments, the tripping force is less than half of the bimetal deflection force when the ambient temperature is about negative thirty degrees Celsius (e.g., ± ten degrees).

Referring to FIG. 3B, the circuit breaker 100 is shown in the tripped position. The armature 140 has been moved from the engaged position (FIG. 3A) to the tripped position by, for example, the solenoid 170 exerting a force on the armature 140 in the direction of arrow A. In extreme cold ambient temperatures such as, for example, ambient temperatures equal to or less than negative twenty degrees Celsius, when the bimetal 110 deflects in the direction of arrow B, the yoke stop 160 ensures that moving the armature 140 from the engaged position to the tripped position, thereby overcoming the normal tripping forces in the direction of arrow B, will always trip the circuit breaker 100. In some embodiments, moving the armature 140 from the engaged position to the tripped position will trip the circuit breaker 100 without relying on bimetal-thermal-assist tripping, also known as thermal-assist tripping. Thermal-assist tripping requires an extended period of time to trip the circuit breaker 100, which may be undesirable. According to some embodiments, moving the armature 140 from the engaged position to the tripped position will trip the circuit breaker 100 without relying on a thermal assist within eight-half cycles of current in an ambient temperature no less than negative thirty-five degrees Celsius. Thus, an advantage of the yoke stop 160 is that thermal assist tripping can be eliminated from the circuit breaker 100.

Figure 1:
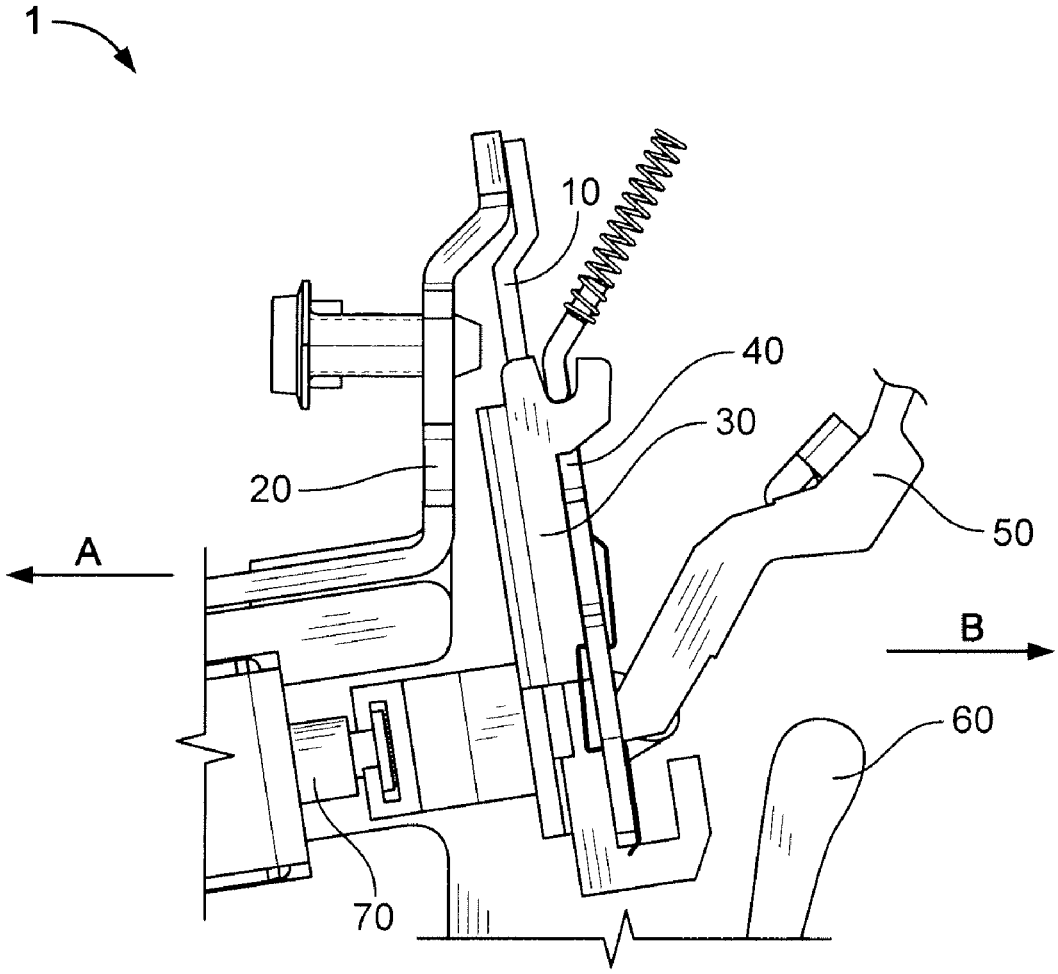
FIG. 1 (Prior Art)
FIG. 1 is a partial top view of a prior art circuit breaker.

Comparing the circuit breaker of FIG. 1 to the circuit breaker of FIGS. 2 and 3A-3B, the yoke stop 160 is positioned such that the yoke stop 160 absorbs the bimetal deflection force thereby allowing the solenoid to trip the circuit breaker 100 without having to overcome the additional bimetal deflection force. By contrast, the bimetal deflection force in the circuit breaker of FIG. 1 causes the bimetal 10 to deflect in the direction of arrow B. Such a deflection causes the yoke 30 to move in the direction of arrow B. As the base stop 60 is spaced away from the yoke hook 34, the bimetal 10 is free to deflect in the direction of arrow B, thereby causing the yoke 30 to move in the direction of arrow B. As the yoke 30 moves in the direction of arrow B, the trip lever 50 becomes further engaged with the latch seat 46. Thus, tripping the circuit breaker 10 requires the solenoid 70 to overcome the armature biasing force, the frictional engagement force, and the bimetal deflection force before the trip lever 50 will disengage from the latch seat 46. Overcoming the bimetal deflection force requires larger solenoids as the overall tripping requirements, which include the normal tripping forces plus the bimetal deflection force, can be multiple times greater than the normal tripping force requirements of the circuit breaker 100 operating in extreme ambient temperatures (e.g., negative thirty-five degrees Celsius).

Moreover, the base stop 60 in FIG. 1 is configured and positioned relative to the yoke 30 to prevent bimetal deflection only during high interrupting current testing as magnetic repulsion forces from the load terminal push the bimetal 10 in the direction of arrow B. The base stop 60 is designed and positioned only to prevent the bimetal 10 from taking a mechanical set due to these magnetic repulsion forces. The base stop 60 fails to absorb bimetal deflection forces in extreme cold ambient temperatures. Thus, the prior-art circuit breaker 1 cannot function properly in extreme cold ambient temperatures at low current levels with an electronically detected fault (e.g., GFI).

Additionally, as shown in FIG. 1, the configuration and positioning of the base stop 60 allows for the armature 40 to be moved from the engaged position to a position where the armature 40 contacts a face of the yoke 30 while the trip lever 50 remains engaged with the latch seat 46 of the armature 40. Such a situation requires thermal-assist tripping, which as discussed above may be undesirable.

As discussed above, according to some embodiments, the circuit breaker is a three-pole circuit breaker wherein three poles are assembled in a common housing. In these embodiments, each of the poles includes a bimetal, a yoke, an armature, a trip lever, and a yoke stop. The three poles are interconnected together with a common trip bar such that when one pole trips, the common trip bar exerts a sufficient force to trip the remaining two un-tripped poles. Thus, to trip all three poles, the first pole must not only overcome the normal tripping forces associated with the first pole, but also the normal tripping forces of other two poles. In extreme ambient temperatures, the first pole tripping mechanism may not have enough force to overcome the normal tripping forces and additional bimetal deflection forces of the other two poles. However, the yoke stops are configured and positioned to reduce the overall tripping requirements of the three poles as described above in connection with circuit breaker 100. Thus, an advantage of the yoke stop is to reduce the overall tripping requirements in a multi-pole circuit breaker, which results in a more robust and reliable tripping mechanism in normal and extreme operating conditions.

Words of degree such as "substantially" or "about" are used herein in the sense of "at, or nearly at, given the process, control, and material limitations inherent in the stated circumstances" and are used herein to keep the unscrupulous infringer from taking advantage of unqualified or absolute values stated for exemplary embodiments.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A circuit breaker having a latched position in which electrical current flows across the circuit breaker and a tripped position in which no electrical current flows across the circuit breaker, the circuit breaker comprising:

(a) a bimetal having a load end and a free end, the bimetal deflecting in a first direction in response to a first condition and deflecting in a second direction opposite the first direction in response to a second condition, wherein the first condition is an increase in temperature of the bimetal and the second condition is a decrease of the temperature of the bimetal;

(b) a yoke secured to the free end of the bimetal;

(c) an armature pivotally coupled to a housing of the circuit breaker via an armature spring, the armature having a latch seat positioned to engage a trip lever thereby creating the latched position, the armature and the trip lever being separable by a tripping force, the armature spring exerting an armature biasing force on the armature in the second direction in response to application of the tripping force;

(d) a solenoid operatively coupled to the armature, the solenoid configured to apply the tripping force to the armature in the first direction in response to a fault condition, thereby changing the circuit breaker from the latched position to the tripped position; and (e) a yoke stop positioned adjacent to the yoke and opposing a bimetal deflection force on the yoke in the second direction in response to the second condition, wherein the tripping force under the second condition is less than a sum of a frictional engagement force between the trip lever and the latch seat plus the armature biasing force plus the bimetal deflection force, and wherein the yoke stop absorbs the bimetal deflection force under the second condition.

2. The circuit breaker of claim 1, wherein the tripping force under the second condition is less than the bimetal deflection force.

3. The circuit breaker of claim 1, wherein the tripping force under the second condition is no more than ten percent more than the sum of the frictional engagement force and the armature biasing force.

4. The circuit breaker of claim 1, wherein the first condition is an increase in temperature of the bimetal and the second condition is a decrease of the temperature of the bimetal to at least about negative thirty-five degrees Celsius.

5. The circuit breaker of claim 1, wherein the yoke stop absorbs the bimetal deflection force such that the tripping force is independent of the bimetal deflection force.

6. The circuit breaker of claim 5, wherein the yoke stop is positioned such that the yoke contacts the yoke stop when the circuit breaker is in the latched position.

7. The circuit breaker of claim 5, wherein the yoke stop prevents the yoke from moving in the second direction in response to the second condition.

8. The circuit breaker of claim 1, wherein the yoke has a pivot end and a hook end, the hook end including a yoke hook; and the yoke stop is contacting an outer surface of the yoke hook while the circuit breaker is in the latched position.

9. The circuit breaker of claim 8, wherein the bimetal has a calibrated position, the calibrated position being adjustable by adjusting a calibration screw, the calibration screw being coupled to the load terminal such that turning the calibration screw causes the second end of the bimetal to move away from the yoke stop.

10. The circuit breaker of claim 9, wherein the calibration screw is adjusted such that at least a portion of the outer surface of the yoke hook abuts the yoke stop.

11. The circuit breaker of claim 8, wherein an ambient temperature is about negative thirty-five degrees Celsius.

12. The circuit breaker of claim 8, wherein the solenoid is physically smaller in size than a solenoid of a circuit breaker without the yoke stop in an ambient temperature of about negative thirty-five degrees Celsius.

13. The circuit breaker of claim 1, wherein the yoke stop prevents the yoke from moving in the second direction in response to the second condition.

14. The circuit breaker of claim 1, wherein the yoke stop absorbs the bimetal deflection force such that movement of the armature from the first position to the second position causes the circuit breaker to trip without having to overcome a substantial portion of the bimetal deflection force.

15. A circuit breaker having an on position and a tripped position, the circuit breaker comprising:

(a) a bimetal configured to bend in a first direction in response to a first condition and to bend in a second direction opposite the first direction in response to a second condition, the second condition causing the bimetal to exert a bimetal deflection force in the second direction;

(b) a yoke coupled to the bimetal;

(c) an armature resiliently coupled to a housing of the circuit breaker, the armature including a void positioned to engage a trip lever;

(d) a solenoid operatively coupled to the armature, the solenoid configured to apply a tripping force to the armature in the first direction in response to a fault condition; and (e) a yoke stop positioned adjacent to the yoke, the yoke stop absorbing the bimetal deflection force such that the tripping force is independent of the bimetal deflection force.

16. The circuit breaker of claim 15, wherein the yoke stop is positioned such that the yoke contacts the yoke stop when the circuit breaker is in the on position.

17. The circuit breaker of claim 15, wherein the yoke stop prevents the yoke from moving in the second direction in response to the second condition.

18. The circuit breaker of claim 15, wherein the first condition is an increase in temperature of the bimetal and the second condition is a decrease of the temperature of the bimetal.

* * * * *